United States Patent [19]

Nojiri et al.

[11] Patent Number: 4,828,644

[45] Date of Patent: May 9, 1989

[54] ETCHING DEVICE FOR SEMICONDUCTOR WAFERS

[75] Inventors: Hidetoshi Nojiri, Yokosuka; Masahi Nakamura, Miura, both of Japan

[73] Assignee: Nissan Motor Co., Ltd., Yokohama, Japan

[21] Appl. No.: 61,197

[22] Filed: Jun. 15, 1987

[30] Foreign Application Priority Data

Jun. 16, 1986 [JP] Japan ..... 61-138322

[51] Int. Cl.[4] ..... H01L 21/306; C23F 1/02; A24F 15/00; B65D 85/10

[52] U.S. Cl. ..... 156/345; 156/627; 156/662; 204/260; 204/261; 204/263; 204/129.1; 204/273

[58] Field of Search ..... 156/345, 635, 627, 642, 156/662; 204/129.1, 263, 260, 273, 261

[56] References Cited

U.S. PATENT DOCUMENTS

| | | | |
|---|---|---|---|
| 3,957,615 | 5/1976 | Diefenbacher | 204/260 |
| 3,984,303 | 10/1976 | Peters et al. | 204/260 |
| 4,073,708 | 2/1978 | Hicks, Jr. | 156/642 |
| 4,121,991 | 10/1978 | Miller et al. | 204/260 |
| 4,212,714 | 7/1980 | Coker et al. | 204/263 |
| 4,521,281 | 6/1985 | Kadija | 204/263 |
| 4,533,443 | 8/1985 | Wrighton et al. | 204/263 |
| 4,615,776 | 10/1986 | Sasaki et al. | 204/129.1 |

OTHER PUBLICATIONS

M. Hirata et al, "A Silicon Diaphragm Formation for Pressure Sensor by Anodic Oxidation Etch-Stop", IEEE, 1985, pp. 287-290.

M. Yasuda et al, "Use of a Conductive Partation Plate for Enlargement of Effective Bed Thickness of Fluidized Bed Electrodes", Denki Gakkai Journal, vol. 51, No. 8, 1983, pp. 715, 716.

*Primary Examiner*—David L. Lacey
*Assistant Examiner*—L. Johnson
*Attorney, Agent, or Firm*—Foley & Lardner, Schwartz, Jeffery, Schwaab, Mack, Blumental & Evans

[57] ABSTRACT

Work pieces are immersed in an etchant in a spaced contact free relationship with the electrodes of the system. The two electrodes are separated by a filter which prevents charge carrying particles dispersed in the etchant surrounding the electrode closest to the work pieces and which assume the same charge, from migrating to and contacting the more remote one. The etchant containing the particles is physically agitated whereby the distribution of the particles which transfer electrical energy to the work pieces and induce electrochemical etching thereof is unified.

15 Claims, 1 Drawing Sheet

ETCHING DEVICE FOR SEMICONDUCTOR WAFERS

BACKGROUND OF THE INVENTION

1. Field of the Invention

The present invention relates to an etching device for semiconductor wafers or the like and more specifically to an etching device which greatly simplifies the etching process while providing more uniform and improved quality.

2. Description of the Prior Art

FIG. 1 shows an etching arrangement disclosed in an article entitled A SILICON DIAPHRAGM FORMATION FOR PRESSURE SENSOR BY ANODIC OXIDATION ETCH - STOP by M. Hirata disclosed in the 1985 IEEE colloquium compilation page 287.

With this arrangement in order to electrochemically etch portions of a semiconductor wafer 1 it has been necessary to execute a number of preparatory steps including (by way of example) preparing suitable temporary electrodes on the surface of each wafer prior to the actual etching process and removing the same thereafter.

Further, it has also been necessary to individually connect each of the wafers to a source of electromotive force 2 in a manner such as shown in FIG. 1 in order to actually conduct the etching process. In the instance it is desired to simultaneously etch a number of wafers, as the shape and location of the cathode 3 from the work pieces has a marked effect on the process, extreme care must be exercised when arranging the cathode 3 and the wafers 1 with respect to the same. However, due to the inevitably minute differences in distance and shape which occur despite the most careful efforts to avoid the same, a variation in the quality of the finished articles has thus far proven inevitable.

SUMMARY OF THE INVENTION

It is an object of the present invention to provide an etching arrangement by which one or more semiconductor wafers can be readily and uniformly etched without the need to painstakingly connect each to a source of EMF and precisely arrange the same with respect to an inert electrode of carefully selected shape.

In brief, the above object is achieved by using a technique wherein work pieces are immersed in an etchant in a spaced contact free relationship with the two electrodes of the system; wherein the electrodes are separated by a filter which prevents charge carrying particles dispersed in the etchant surrounding the one closest the work piece and which assume a charge of the same polarity, from migrating toward and contacting the more remote one; and wherein the etchant containing the particles is physically agitated so that the distribution of the particles which transfer electrical energy to the work pieces and induce electrochemical etching thereof, is unified.

More specifically, a first aspect of the present invention takes the form of an etching device comprising: a container containing an etchant fluid; a filter, the filter being disposed in the container in a manner to divide the container into first and second sections, the second section having a site for receiving one or more work pieces; a first electrode disposed in the first section in a manner to be immersed in the fluid; a second electrode disposed in the second section in a manner to be immersed in the fluid; a charge carrying agent mixed with the fluid contained in the second section; and an agitator for agitating the fluid in a manner which tends to unify the distribution of the charge carrying agent in the second section.

A second aspect of the present invention comes in the form of a method of etching comprising the steps of: dividing a container containing an etching fluid into first and second sections using a filter; immersing a first electrode in the first section; immersing a second electrode in the second section; mixing a quantity of charge carrying agent with the fluid contained in the second section; agitating the fluid in the second section in a manner which tends to unify the distribution of the agent therein; and immersing a work piece in the second section in a spaced contact free relationship with the second electrode.

DESCRIPTION OF THE PREFERRED EMBODIMENTS

Figure 1:
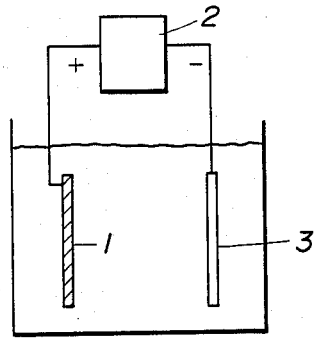
FIG. 1 (PRIOR ART)
FIG. 1 shows the prior art etching arrangement discussed briefly in the opening paragraphs of the instant disclosure.
Figure 2:
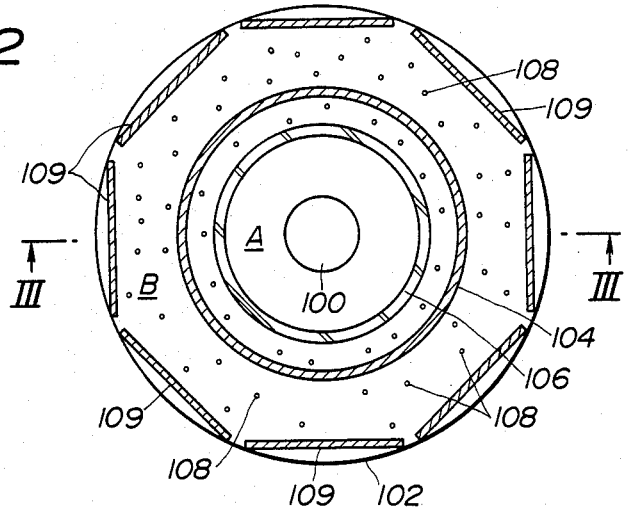
FIGS. 2 and 3 are sectional plan and elevational views of an embodiment of the present invention.
Figure 3:
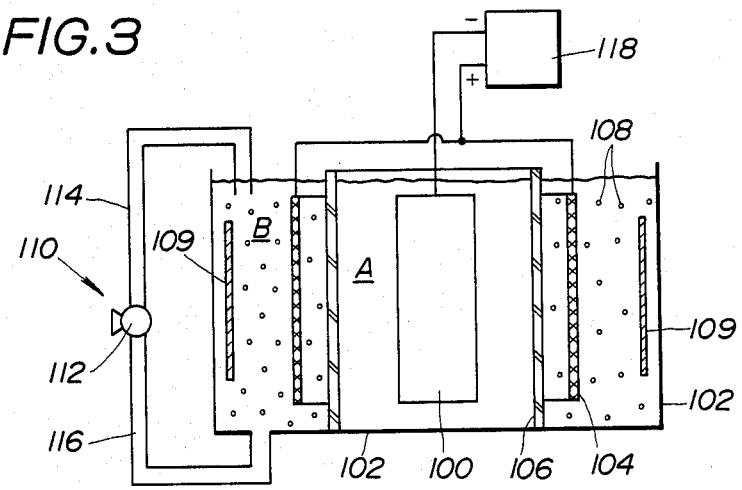

FIGS. 2 and 3 show an embodiment of the present invention. In this arrangement a cylindrical electrode 100 (formed of an inert material) is disposed concentrically in the middle of a circular vat or etching tank 102. A second electrode 104 is disposed in said tank 102 in manner to be concentric with electrode 100.

An annular filter 106 concentric with the electrodes 100, 104 is interposed therebetween in a manner to partition the tank into first and second sections A, B.

The tank is filled with an etching solution which in this embodiment may take the form of an aqueous solution of hydrazine. In the event that it is required to elevate the electrical conductivity of the etchant it is possible to add appropriate quantities of potassium hydroxide.

A suitable amount of "charge carrying" agent which in this embodiment may take the form of carbon particles 108, is added to the etchant in direct contact with the annular electrode contained in the second section B. These particles act as vehicles for moving electrical energy between the annular electrode 104 and work pieces 109 which are disposed in the tank 102 in a spaced contact free relationship with respect to said electrode 104.

The filter 106 prevents the particles 108 from passing therethrough and entering the first section A in which the cylindrical electrode 100 is disposed. This is necessary to prevent the situation wherein the paricles which assume a charge of similar polarity to that of the annular electrode 104, naturally tend to migrate toward and collect on the cylindrical one 100.

An agitating arrangement 110 is provided to circulate and agitate the etchant in the second section in a manner to disperse the carbon particles 108 and ensure that the distribution thereof in the second section B is essentially uniform. In this embodiment this arrangement includes a pump 112 which inducts etchant from the second section B and returns the same back thereinto via conduits 114, 116. However, as will be readily apparent to those skilled in the art, a variety of different arrangements may be used for this purpose if deemed more appropriate and/or if the situation demands.

The electrodes 100, 104 are connected via lead lines to a source of EMF 118. In this embodiment the source is arranged to supply DC at a predetermined voltage and is connected in a manner that the positive terminal (+) is connected with annular electrode 104 while the negative one (−) is connected with the cylindrical electrode 100 disposed in the center of the tank 102.

In the illustrated arrangement 8 work pieces 109 such as semiconductor wafers which require electrochemical etching, are disposed about the inner periphery of the tank 102. As will be apparent the illustrated disposition ensures that the wafers can be readily located in an essentially uniform manner with respect to, and at an essentially uniform distance from, the electrode arrangement. Although not shown, means for suitably securing the work pieces in the illustrated position is provided. This arrangement may take the form of slots, clamps or any other type of mechanical arrangement which will retain the work pieces in place despite the agitation which unifies the distribution of the charge carrying particles and prevents movement which could lead to contact with the annular electrode and/or sufficient change in distance therefrom which would lead to a variation in the etching uniformity.

With the present invention the work pieces 109 need not be directly connected with the source of EMF 118 and do not require temporary electrodes and the like for reasons which will become apparent.

During the operation of the above described device, the pump 112 is actuated to agitate the etchant in the second section B of the tank 102 and uniformly disperse the charge carrying particles 108. The application of a predetermined voltage across the electrodes 100, 104 causes the particles 108 which are circulating in the second section B to develop a positive (+) charge. Upon encountering the work pieces 109 the charge carrying particles 108 induce electrochemical etching and cause material to be removed from the semiconductor wafers. For further reference to the underlying mechanism by which this etching takes place reference may be had to an article in DENKI GAKKAI JOURNAL 51 No. 8 published in 1983 by Morihiro Yasuda et al.

The present invention is not limited to the above described embodiment which utilizes circular shaped tanks and electrodes and may be applied to arrangements wherein the electrodes are flat and disposed in a parallel configuration (or the like) in a rectangular tank or to arrangements wherein the tank is polygonal and provided with corresponding electrodes etc.

With the present invention as the pump 112 maintains the distribution of the charge carrying particles 108 which transfer the charge between the anode and the work pieces 109 essentially uniform, not only is it unnecessary to individually connect the work pieces 109 with the source of EMF 118 but the sensitivity to the distance from and the shape of the electrodes is attenuated, facilitating uniform etching and reducing the precision with which the pieces must be disposed in the etching tank.

What is claimed is:

1. An etching device comprising:

a container for containing an etchant fluid;

filter means for retaining a particulate on one side thereof, said filter means being disposed in said container, positioned and arranged so as to divide the container into first and second sections, said second section having a site for receiving one or more work pieces;

a first electrode disposed in said first section;

a particulate second electrode disposed in said second section;

a particulate charge carrying agent contained in said second section for mixing with fluid; and agitator means for agitating fluid in said container in a manner which tends to unify the distribution of said charge carrying agent in said second section.

2. An etching device as claimed in claim 1, wherein the site in said second section is arranged so that a plurality of work pieces can be disposed in said container in an essentially uniform relationship with respect to said first and second electrodes.

3. An etching device as claimed in claim 1, further comprising a source of EMF, said source being connected to said first and second electrodes so as to induce a potential difference therebetween.

4. An etching device as claimed in claim 3, wherein said charge carrying agent is an agent which develops a charge which is the same as the polarity of said second electrode.

5. An etching device as claimed in claim 1, consisting essentially of the recited elements.

6. An etching arrangement comprising:

filter means for retaining particulate on one side thereof-positioned and arranged so as to divide said container into first and second sections, said container containing an etching fluid;

a first electrode immersed in said first section;

a second electrode immersed in said second section;

a quantity of undissolved particulate charge carrying agent mixed with the fluid contained in said second section;

means for agitating the fluid in said second section in a manner which tends to unify the distribution of said agent therein; and means for inducing a potential across said first and second electrodes.

7. An etching arrangement as claimed in claim 6, further comprising: means for supporting a plurality of work pieces in said second section in a spaced contact free relationship with said second electrode.

8. An etching device as claimed in claim 6, consisting essentially of the recited elements.

9. An etching device comprising:

a container for containing an etchant fluid, said container having one of a circular and polygonal shape;

a first electrode, said first electrode being disposed in the middle of said container;

filter means for retaining a particulate on one side thereof, said filter means being disposed in said container positioned and arranged so as to surround said first electrode and disposed in said second section and arranged to extend concentrically around said first electrode and said filter means;

a plurality of sites for receiving work pieces, said sites being arranged about the inner periphery of said container and symmetrically with respect to said second electrode;

a particulate charge carrying agent contained in said second section for mixing with the fluid; and an agitator for agitating fluid in said second section in a manner which tends to unify the distribution of said particulate charge carrying agent therein.

10. An etching device as claimed in claim 9, wherein said particulate charge carrying agent is an undissolved particulate solid.

11. An etching device as claimed in claim 9, wherein said sites are arranged so that the work pieces which are received therein are equidistantly arranged with respect to said second electrode.

12. An etching device as claimed in claim 11, wherein said sites for receiving work pieces are shaped to receive semiconductor wafers.

13. An etching device as claimed in claim 9, consisting essentially of the recited elements.

14. An article of manufacture for etching comprising:

a container containing an etchant fluid, said container having one of a circular and polygonal shape;

a first electrode, said first electrode being disposed in the middle of said container;

filter means for retaining particulate on one side thereof, said filter means being disposed in said container positioned and arranged so as to surround said first electrode and;

a second electrode, said second electrode being disposed in said second section and arranged to extend concentrically around said first electrode and said filter means;

a plurality of sites for receiving work pieces, said sites being arranged about the inner periphery of said container and symmetrically with respect to said second electrode;

a particulate charge carrying agent mixed with the fluid contained in said second section; and an agitator for agitating the fluid in said second section in a manner which tends to unify the distribution of said particulate charge carrying agent therein.

15. An etching device as claimed in claim 14, wherein said etching solution takes the form of an aqueous solution of hydrazine.

* * * * *